US005544457A

United States Patent [19]

Labrecque

[11] Patent Number: 5,544,457

[45] Date of Patent: Aug. 13, 1996

[54] BEAD FOR RETAINING AND AIR SEALING A WINDOWPANE AND WINDOW ASSEMBLY THEREWITH

[75] Inventor: Normand Labrecque, Beloeil, Canada

[73] Assignee: A. & D. Prevost Inc., Richelieu, Canada

[21] Appl. No.: 385,756

[22] Filed: Feb. 8, 1995

[51] Int. Cl.[6] ..... E06B 3/66

[52] U.S. Cl. ..... 52/204.69; 52/730.5

[58] Field of Search ..... 52/204.7, 204.69, 52/204.62, 204.705, 204.593, 656.2, 656.5, 717.01, 717.02, 730.3, 730.4, 730.5, 734.1

[56] References Cited

U.S. PATENT DOCUMENTS

| | | | |
|---|---|---|---|
| 3,196,998 | 7/1965 | Owen | 52/730.5 X |
| 3,475,870 | 11/1969 | Birum | 52/730.5 X |

FOREIGN PATENT DOCUMENTS

| | | | |
|---|---|---|---|
| 1322128 | 9/1993 | Canada . | |
| 3111785 | 10/1982 | Germany | 52/204.62 |
| 2131860 | 6/1984 | United Kingdom | 52/204.69 |
| 2141165 | 12/1984 | United Kingdom | 52/204.7 |
| 2227275 | 7/1990 | United Kingdom | 52/204.7 |

OTHER PUBLICATIONS

Garden, G. K., "Glazing Design", in Canadian Building Digest, Ottawa, Jul. 1964.

*Primary Examiner*—Carl D. Friedman
*Assistant Examiner*—Timothy Kang
*Attorney, Agent, or Firm*—Merchant, Gould, Smith, Edell, Welter & Schmidt, P.A.

[57] ABSTRACT

The bead comprises a frame having front and rear longitudinally extending spaced-apart flanges. The front flange faces the windowpane when the bead is interlocked with a lateral projection of a framework. A weatherstrip is connected and extends along the frame before the front flange. The weatherstrip has a portion overlapping at least an end portion of the front flange for preventing direct contact of the front flange with the framework. Two flexible portions project from the weatherstrip. The first flexible portion presses against the periphery of the windowpane and the second flexible portion presses against the framework. A securing device interlocks the bead with the lateral projection of the framework. Heat losses are reduced because the bead has no direct contact with the framework and with the air surrounding the periphery of the weatherstrip.

10 Claims, 6 Drawing Sheets

BEAD FOR RETAINING AND AIR SEALING A WINDOWPANE AND WINDOW ASSEMBLY THEREWITH

FIELD OF THE INVENTION

The present invention relates to a bead and a window assembly comprising a bead for retaining and air sealing a windowpane to a framework. The invention is particularly well adapted for a factory-sealed multiple glazing unit and may be used in locations such as commercial buildings, stores, factories and houses.

BACKGROUND OF THE INVENTION

Snap-on beads are used in prior art windows as a very convenient way for retaining a windowpane. The beads are removable parts interlocked with the framework for exerting a holding pressure on the periphery of the windowpane, more specifically the periphery which is on the side opposite the rabbet of the framework. The beads comprise a polymeric glazing material, also called a weatherstrip or wedge gasket, that is in direct contact with the windowpane.

The framework holds the windowpane in a wall opening or a similar location. It may be made of various materials such as aluminum, polyvinyl chloride (PVC), fiberglass, wood, etc. The windowpane is usually adjusted in the framework with shims, such as neoprene setting blocks, and pushed against the glazing sealing tape. The glazing sealing tape is previously set in the rabbet and is used to deter rain penetration. The beads then lock the windowpane with a proper compression between their weatherstrips and the glazing sealing tape.

In high performance windows, a heel bead of gunnable acrylic sealant is installed once the windowpane is in place. The heel bead is installed by hand all around in the space between the perimeter of the windowpane and the framework for providing an air seal. The heel bead is used in conjunction with a backing rod previously installed by hand in the space.

Installation of the heel bead is a very critical step because if it is too thin, it would not be suitably efficient and if too deeply installed, it may contact the sealant of the factory-sealed multiple glazing unit, if any. Since many sealants are chemically incompatible, very important problems may arise if the sealant of such unit deteriorates, thereby possibly leading to the penetration of humidity and condensation between the multiple glazings. In the latter case, the sealed unit will have to be replaced by the contractor or the owner at his own expenses because the warranty from the unit manufacturers exclude claims of this ground.

Great care must be taken when installing a heel bead, but quality is often sacrificed to speed up the process because the installation is time-consuming and tedious for the worker and costly for the contractor. As a result, the heel bead is often imperfect and it will be hard to detect the flaws once the snap-on beads are in position in the framework.

Additionally, although backing rods are available in different sizes and shapes, the same set of backing rods is often used all around the windowpane in spite of the fact that the space between the perimeter of the windowpane and the framework is not always equal on all sides. As a result, the backing rod is not positioned at the optimum deepness and the heel bead will not be suitable.

The presence of the shims is also a problem when installing a heel bead because it has to be often deviated or disjoined around the shims, increasing the possibility of flaws.

Another drawback with the use of a heel bead arises whenever the windowpane has to be replaced, after a break thereof for instance. If this happens, the old heel bead must be completely removed all around the framework so that the surface be fully clean and prepared for the new heel bead, otherwise the new heel bead would not be satisfactory. The surface cleaning is often a costly, time-consuming and tedious process, as it is for the installation of the new heel bead itself.

A further drawback with the use of a heel bead is that it does not significantly insulate the region between the periphery of the windowpane and the front flange of the bead, which is particularly notable in the case of an aluminum bead and framework. It is due to the direct contact of the front flange with the part of the framework adjacent the perimeter of the windowpane. This results in important heat losses through the beads and to possible condensation on the beads during cold weather, especially on the lower horizontal bead. The heat losses are even greater if the heel bead is defective.

SUMMARY OF THE INVENTION

The object of the present invention is to resolve the above-mentioned drawbacks by providing a snap-on bead with a weatherstrip providing a suitable air seal and insulation capabilities between the front flange, the windowpane and the framework.

More particularly, the object of the present invention is to provide a bead for retaining and air sealing a windowpane to a framework, the bead being in position when interlocked with a lateral projection of the framework, the bead comprising:

a bead frame having a front and a rear longitudinally extending flange which are spaced apart from each other, the front flange being in facing relationship with the windowpane when the bead is in position;

a weatherstrip connected and extending along the bead frame before the front flange, the weatherstrip having a portion overlapping at least an end portion of the front flange for preventing direct contact of the front flange with the framework, the weatherstrip comprising a first flexible portion projecting therefrom for pressing against the periphery of the windowpane when the bead is in position, and a second flexible portion projecting from the weatherstrip for pressing against the framework when the bead is in position; and securing means for interlocking the bead with the lateral projection of the framework, the securing means at least comprising a longitudinally extending tongue portion projecting from the weatherstrip and adapted to be engaged in a corresponding groove portion of the lateral projection of the framework.

The object of the present invention is also to provide a polymeric bead for retaining and air sealing a windowpane to a framework, the bead being in position when interlocked with a lateral projection of the framework, the bead comprising:

a bead frame having a front and a rear longitudinally extending flange which are spaced apart from each other, the front flange being in facing relationship with the windowpane when the bead is in position;

a weatherstrip extending along the bead frame before the front flange and projecting therefrom, the weatherstrip comprising a first flexible portion for pressing against the periphery of the windowpane when the bead is in position, and a second flexible portion for pressing against the framework when the bead is in position; and securing means for interlocking the bead with the lateral projection of the framework, the securing means at least comprising a longitudinally extending tongue portion projecting from the bead frame and adapted to be engaged in a corresponding groove portion of the lateral projection of the framework.

It is also an object of the present invention to provide a window assembly comprising:

a framework having a lateral projection;

a windowpane to be set in the framework;

a bead for retaining and air sealing the windowpane to the framework, the bead being in position when interlocked with the lateral projection of the framework, the bead comprising:

a bead frame having a front and a rear longitudinally extending flange which are spaced apart from each other, the front flange being in facing relationship with the windowpane when the bead is in position;

a weatherstrip connected and extending along the bead frame before the front flange, the weatherstrip having a portion overlapping at least an end portion of the front flange for preventing direct contact of the front flange with the framework, the weatherstrip comprising a first flexible portion projecting therefrom for pressing against the periphery of the windowpane when the bead is in position, and a second flexible portion projecting from the weatherstrip for pressing against the framework when the bead is in position; and securing means for interlocking the bead with the lateral projection of the framework, the securing means at least comprising a longitudinally extending tongue portion projecting from the weatherstrip and adapted to be engaged in a corresponding groove portion of the lateral projection of the framework.

It is still an object of the present invention to provide a window assembly comprising:

a polymeric framework having a lateral projection;

a windowpane to be set in the framework;

a polymeric bead for retaining and air sealing the windowpane to the framework, the bead being in position when the bead is interlocked with the lateral projection of the framework, the bead comprising:

a bead frame having a front and a rear longitudinally extending flange which are spaced apart from each other, the front flange being in facing relationship with the windowpane when the bead is in position;

a weatherstrip extending along the bead frame before the front flange and projecting therefrom, the weatherstrip comprising a first flexible portion for pressing against the periphery of the windowpane when the bead is in position, and a second flexible portion for pressing against the framework when the bead is in position; and securing means for interlocking the bead with the lateral projection of the framework, the securing means at least comprising a longitudinally extending tongue portion projecting from the bead frame and adapted to be engaged in a corresponding groove portion of the lateral projection of the framework.

A non restrictive description of preferred embodiments will now be given with reference to the appended drawings.

DESCRIPTION OF PREFERRED EMBODIMENTS

REFERENCE NUMERALS

Figure 1:
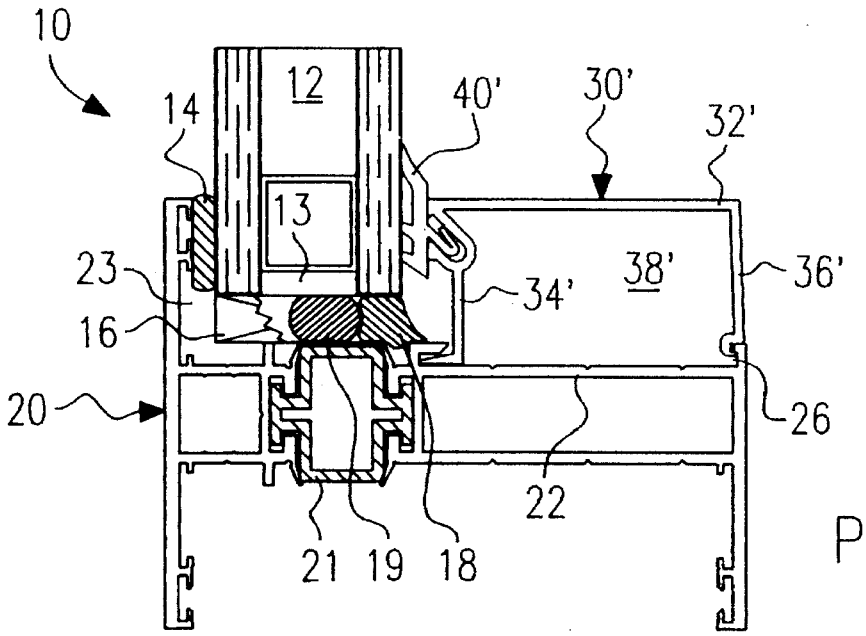
FIG. 1 PRIOR ART
FIG. 1 is a cross-sectional view of a window assembly with a bead according to a first example of the prior art.

The appended drawings and the present description relate to the following reference numerals:

10 window assembly
12 windowpane
13 glazing sealant
14 glazing tape
16 shims
18 heel bead (prior art)
19 backing rod (prior art)
20 framework
21 insulating element
22 lateral projection of the framework
23 rabbet
24 front groove (of lateral projection, first embodiment)
26 rear groove (of lateral projection, first embodiment)
28 front groove (of lateral projection, second embodiment)
30 bead
32 bead frame
34 front flange
36 rear flange
38 hollow section (of bead)
40 weatherstrip
42 flexible portion
44 tongue portion
46 flexible lower portion
48 hollow section (between bead and weatherstrip)

In the drawings, each numeral with an apostrophe refers to a corresponding element in the prior art bead.

General Description of the Invention

The present invention relates to a bead (30) used in a window assembly (10) or an assembly of a similar nature. The assembly (10) comprises a windowpane (12) secured to a framework (20), itself secured to the perimeter of an opening in a wall, a ceiling or a floor. It may be used in locations such as commercial buildings, stores, factories or houses.

The windowpane

The present invention is particularly well adapted with windowpanes, such as factory-sealed multiple glazing unit (12) shown in the drawings. However, a single glazing pane or a non-insulated unit would also be suitable.

The present invention is also not strictly limited to rectangular windowpanes.

It should be noted that the term "perimeter" refers to the sides of the windowpane (12) that are parallel to the framework (20). As for the term "periphery", it refers to the front and rear narrow surfaces juxtaposed to the sides and all around the windowpane (12). For example, the shims (16) are in contact with the perimeter of the windowpane (12), and the flexible portion (42) of the weatherstrip (40) is in contact with the periphery of the windowpane (12).

The framework

The framework (20) shown in the drawings is a simplified illustration of one of many possible embodiments. The typical frameworks usually comprise drip deflectors, weep holes, sills, anchors, etc. A conventional framework (20) comprises two vertical elongated sections (stiles) and two horizontal elongated sections (rails). The framework (20) is divided in a front portion and a rear portion, which are generally separated by an insulating element (21) substantially located under the windowpane (12) if the material of the framework (20) is likely to conduct heat very easily. The framework (20) may otherwise be made of PVC, fiberglass, wood, etc. It should be noted at this point that the framework (20) may comprise a sash in which the windowpane (12) is set, thereby allowing the windowpane (12) to be moved whenever necessary.

Figure 10:
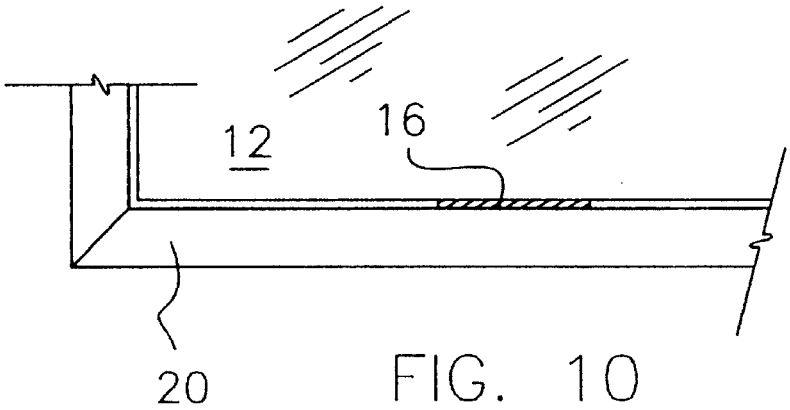
FIG. 10 is an enlarged elevational view of a corner of a window assembly, prior to the positioning of the beads.
Figure 11:
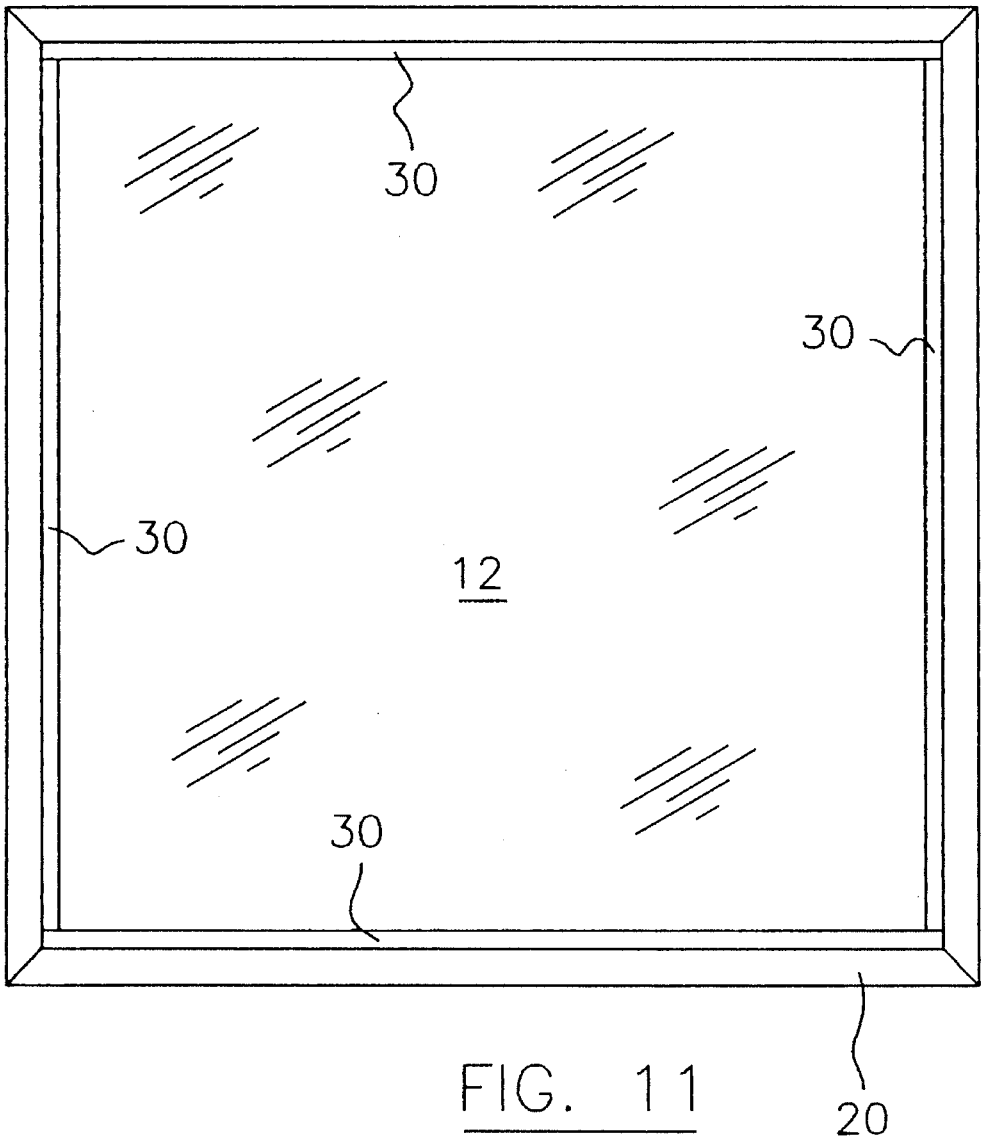
FIG. 11 is a front elevational view of a window assembly with the beads in position.

The windowpane (12) is adjusted in the framework (20) with a plurality of shims (16), such as neoprene setting blocks. FIG. 10 shows an enlarged elevational view thereof. The lower stile of the framework (20) bears the weight of windowpane (12). When it is installed, the windowpane (12) is pushed against the flange of the rabbet (23), on which a glazing sealing tape (14) has been previously set. The glazing tape (14) is used to deter rain penetration between the periphery of the windowpane (12) and the flange of the rabbet (23). It also provides a resilient support on one side of the windowpane (12).

One portion of the framework (20), on either the exterior or more likely the interior side, comprises a lateral projection (22). The lateral projection (22) is adapted to receive the bead (30) once it is interlocked thereon. The other side of the windowpane (12) is held by the flange of the rabbet (23).

The bead

Each bead (30) comprises a bead frame (32) having a front flange (34) and a rear flange (36) which are longitudinally extending all along the bead frame (32) and spaced-apart from each other. The flanges (34,36) project from the same side of the frame (32), more particularly from the side to be facing the lateral projection (22) of the framework (20). The front flange (34) is the one closer to the windowpane (12) when the bead (30) is in position on the framework (20), which is when the bead (30) is interlocked with the lateral projection (22). The frame (32) defines a hollow section (38).

Figure 8:
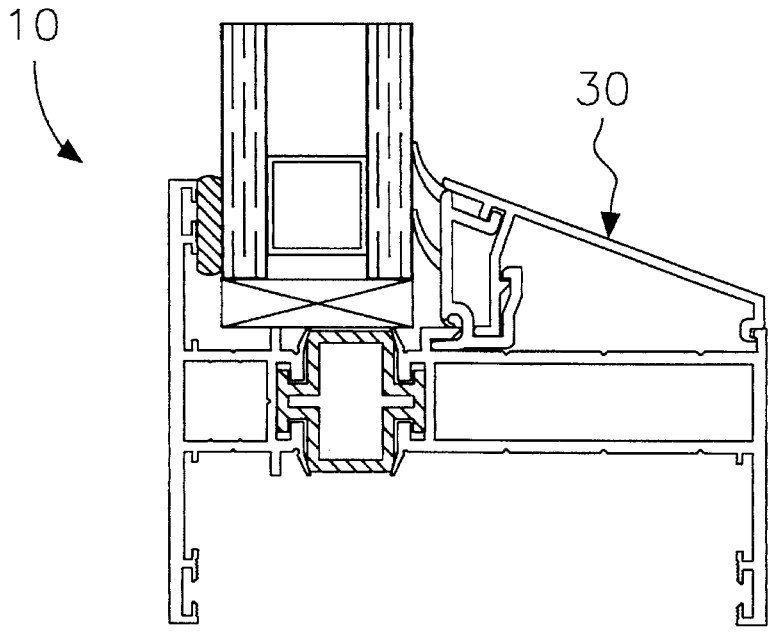
FIG. 8 is a cross-sectional view of a window assembly, showing an example of a wedge-shaped bead.
Figure 9:
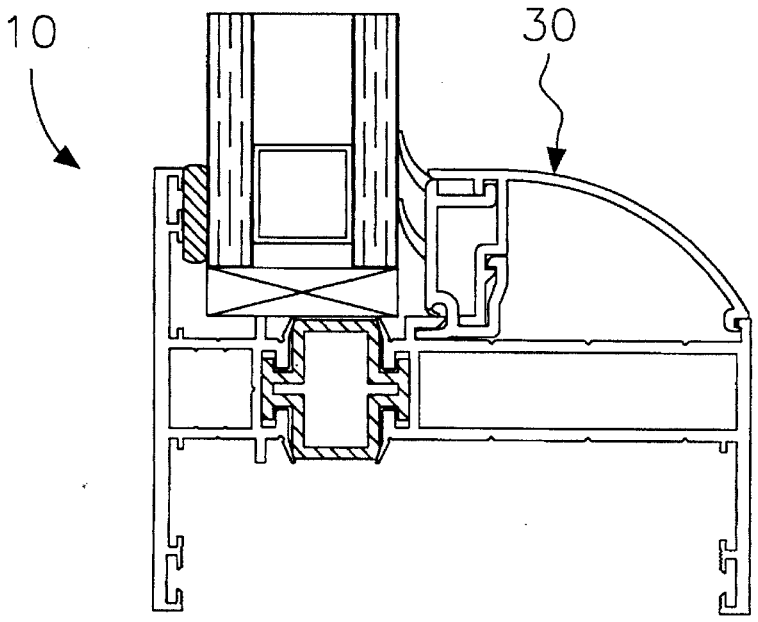
FIG. 9 is a cross-sectional view of a window assembly, showing an example of an arc-shaped bead.

FIGS. 8 and 9 show two of many other possible shapes for the bead (30).

The Weatherstrip

Figure 7:
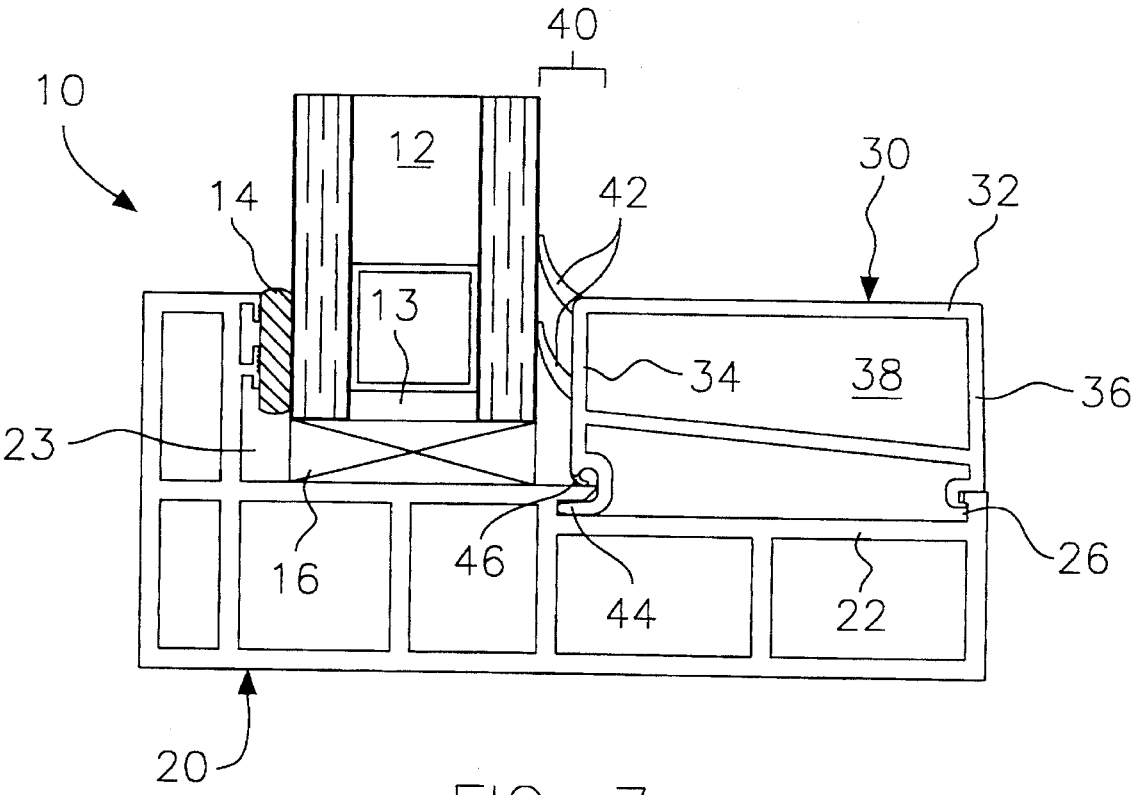
FIG. 7 is a cross-sectional view of a window assembly comprising a PVC bead and framework according to a preferred embodiment of the present invention.

The weatherstrip (40) is connected and extending along the frame (32) before the front flange (34). It can either be provided as a detachable element or as an element integral with the bead frame (32), like the PVC bead shown in FIG. 7.

In the embodiment shown in FIGS. 3 to 6, the weatherstrip (40) has a portion overlapping at least the end portion of the front flange (34) for preventing direct contact between the front flange and the framework (20). In the embodiments shown, the rear portion of the weatherstrip (40) overlaps about half of the front flange (34).

The weatherstrip (40) comprises a first flexible and longitudinally extending portion (42) adapted to be pressed against and air seal the periphery of the windowpane (12) when the bead (30) is in position. The strips (42) allow to exert a firm pressure on the periphery of the windowpane (12), and to have a continuous air seal following very closely the periphery of the windowpane (12). Although the first flexible portion (42) is shown as dual strips parallel to each other in the drawings, it should be noted that other embodiments are also possible. For example, one or more than two strips would also be suitable. The first flexible portion (42) may further be a semi-circular hollow strip (not shown).

Figure 3:
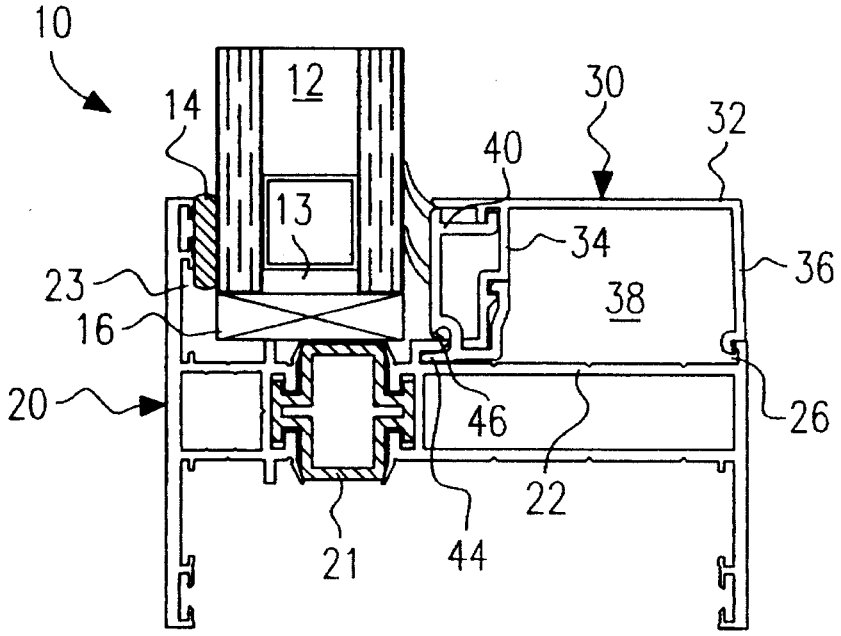
FIG. 3, adjacent to FIG. 1, is a cross-sectional view of a window assembly with a bead according to a first embodiment of the present invention.
Figure 2:
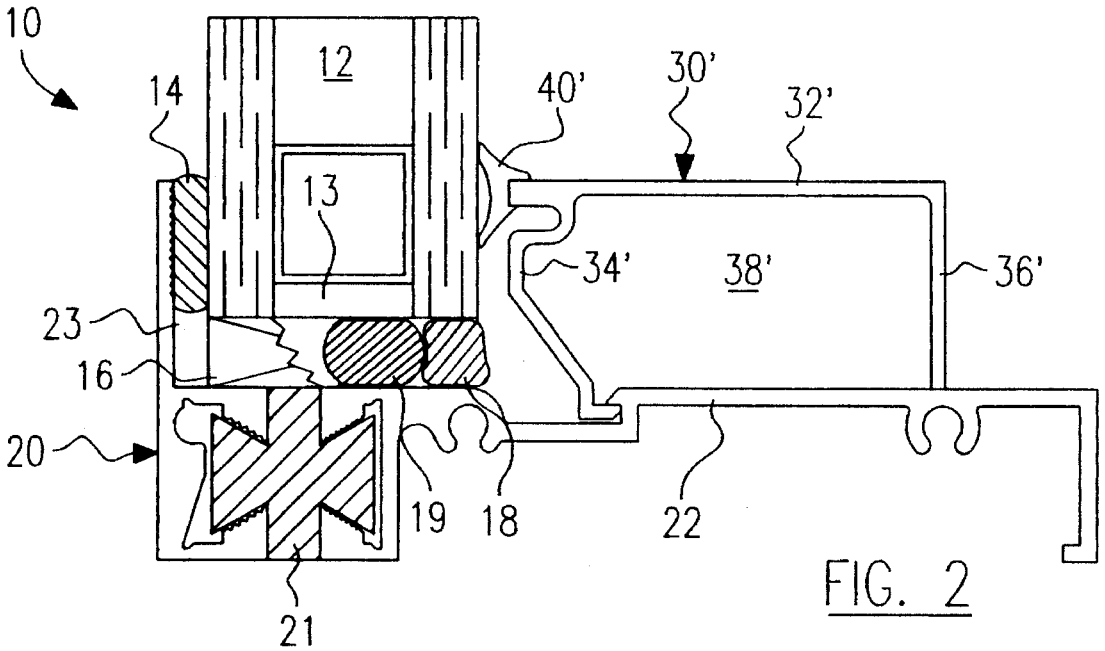
FIG. 2 PRIOR ART
FIG. 2, adjacent to FIG. 4, is a cross-sectional view of a window assembly with a bead according to a second example of the prior art.
Figure 4:
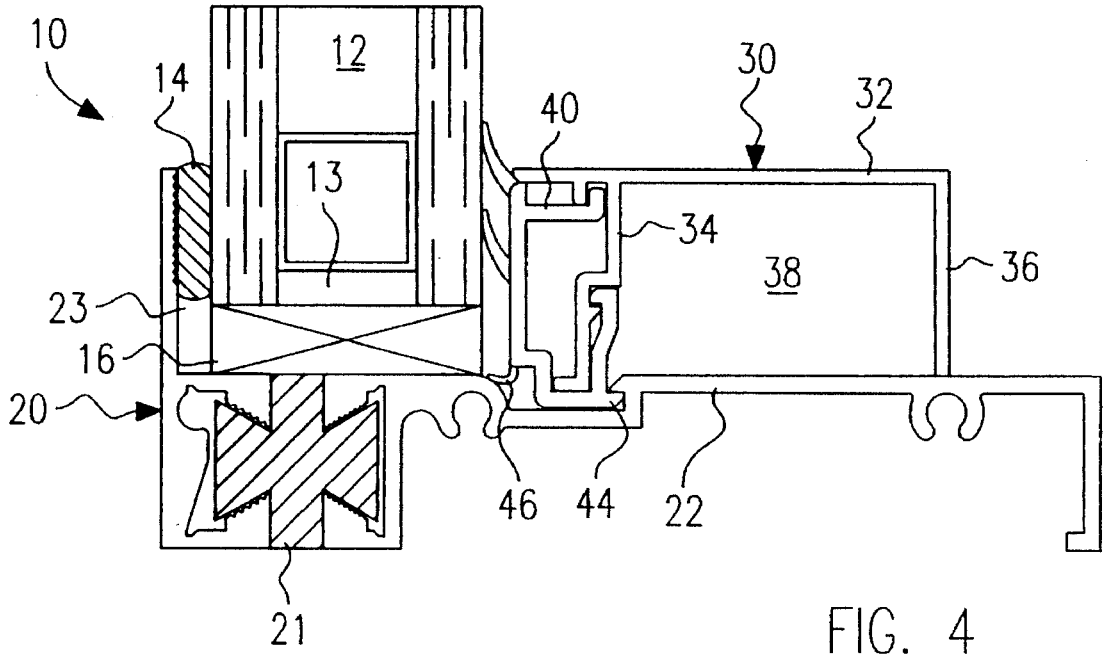
FIG. 4 is a cross-sectional view of a window assembly with a bead according to a second embodiment of the present invention.
Figure 5:
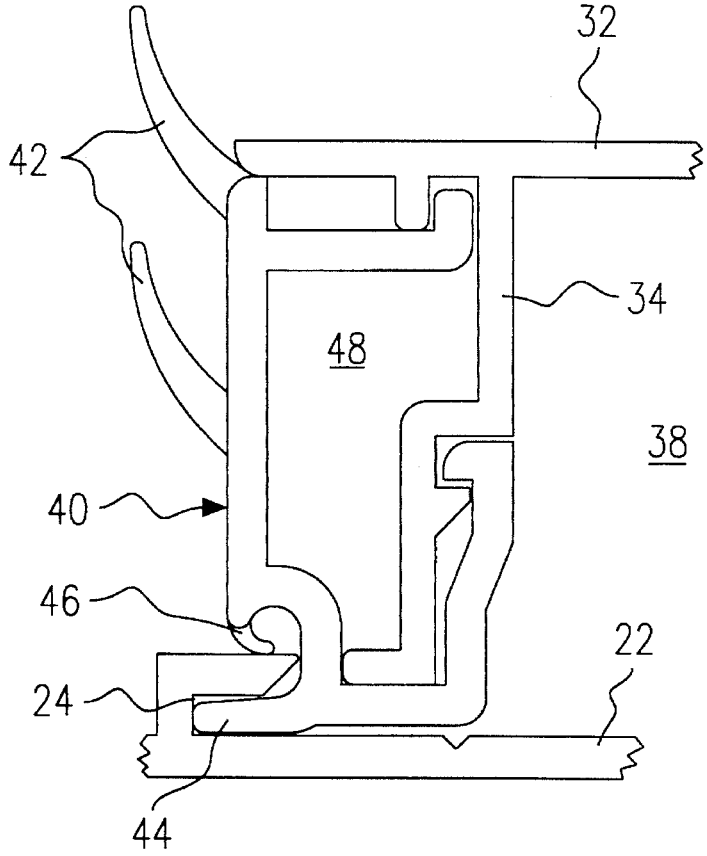
FIG. 5 is an enlarged cross-sectional view of the weatherstrip shown in FIG. 3.
Figure 6:
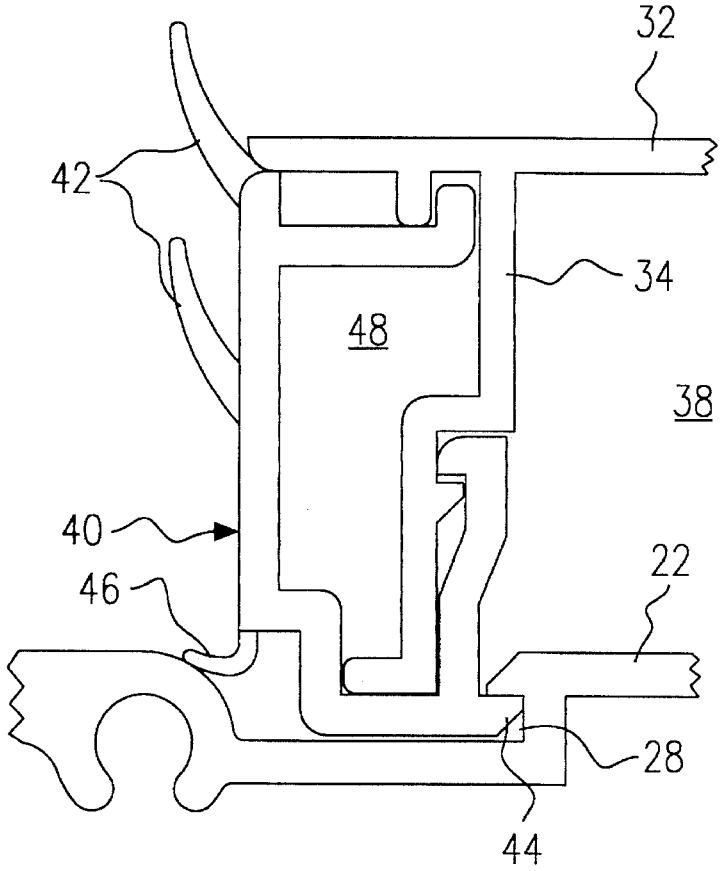
FIG. 6 is an enlarged cross-sectional view of the weatherstrip shown in FIG. 4.

The air seal is complete with the use of a second flexible portion (46) extending along the length of the weatherstrip (40) and pressing on the framework (20), more particularly the front groove (24) in the embodiment of FIGS. 3 and 5, or in front of the front groove (28) in the embodiment of FIGS. 4 and 6.

The weatherstrip (40) is preferably made of a polymeric material with portions having different levels of flexibility. This allows the weatherstrip (40) to have a firm grip on the bead (30) while still having a first flexible portion (42) and a second flexible portion (46). In the case of the PVC bead (30) shown in FIG. 7, the weatherstrip is directly projecting from the bead frame (32).

Preferably, just before installing a bead (30), a very small amount of sealant is provided at its ends for sealing the contact thereof with either the framework (20) or the surface of an adjacent bead.

To further provide thermal insulation, the weatherstrip (40) may be positioned so that one or more hollow sections (48) are defined between the weatherstrip (40) and the front flange (34), as shown in FIGS. 5 and 6.

Securing means

The bead (30) comprises securing means for interlocking the bead (30) with the lateral projection (22) and thereby maintaining the bead (30) in position. There are two main embodiments, but other embodiments are also possible.

In the first main embodiment, shown in FIG. 3 for instance, the lateral projection (22) comprises a front groove (24) and a rear groove (26). when the bead (30) is in position, the flanges (34,36) of the bead (30) are interlocked with their corresponding grooves (24,26).

In the second main embodiment, shown in FIG. 4 for instance, the lateral projection (22) only comprises a front groove (28). When the bead (30) is in position, the front flange (34) of the bead (30) is interlocked only with the front groove (28). The rear flange (36) is resting on the rear flat portion of the lateral projection (22).

As is obvious for a person skilled in the art, the securing means of both main embodiments has to give a suitable stability to the bead (30) so that it may stand important loads occurring during high winds or gusts, especially if the windowpane (12) has a large area.

According to the present invention, the securing means comprises a longitudinally extending tongue portion (44) projecting from the weatherstrip (40) and adapted to be engaged in a corresponding groove portion (24) of the lateral projection (22). The tongue portion (44) of the weatherstrip (40) then acts as a thermal insulator, which prevents contact between the framework (20) and the front flange (34). Ill the case of the PVC bead shown in FIG. 7, the overlapping of the front flange (34) by the weatherstrip (40) is not necessary because the heat conduction is not significantly high.

Although it is not necessary in the present invention, it is possible to have the bead (30) rigidly attached to the framework (20) with a fastening means, such as bolts or screws, for locations like jails, mental institutions, etc.

Advantages of the invention

Because the weatherstrip (40) suitably air seals the windowpane (12), the installation of the beads (30) is very rapid and the quality of the work will be constant.

Another important advantage of the present invention is that no heel bead has to be used when installing a windowpane (12). Whenever the windowpane (12) has to be replaced, the surface clean and preparation will be very easy to do and the installation time will be reduced to a minimum.

A further advantage of the present invention is that the bead (30) of the present invention reduces the thermal conduction compared to prior art assemblies where the front flange (34') is in contact with the part of the framework (20) adjacent to the perimeter of the windowpane (12). The bead (30) of the present invention will thus reduce heat losses therethrough and reduce the possibility of condensation on the beads (30) during cold weather.

Scope of the present description

Although preferred embodiments of the invention have been described in detail herein and illustrated in the accompanying drawings, it is to be understood that the invention is not limited to these precise embodiments and that various changes and modifications may be effected therein without departing from the scope or spirit of the invention.

What is claimed is:

1. A bead for retaining and air sealing a windowpane to a framework, the bead being in position when interlocked with a lateral projection of the framework, the bead comprising:

a bead frame having a front and a rear longitudinally extending flange which are spaced apart from each other, the front flange being in facing relationship with the windowpane when the bead is in position;

a weatherstrip connected and extending along the bead frame before the front flange, the weatherstrip having a portion overlapping at least an end portion of the front flange for preventing direct contact of the front flange with the framework, the weatherstrip comprising a first flexible portion projecting therefrom for pressing against the periphery of the windowpane when the bead is in position, and a second flexible portion projecting from the weatherstrip for pressing against the framework when the bead is in position; and securing means for interlocking the bead with the lateral projection of the framework, the securing means at least comprising a longitudinally extending tongue portion projecting from the weatherstrip and adapted to be engaged in a corresponding groove portion of the lateral projection of the framework.

2. A bead according to claim 1, wherein the weatherstrip comprises a front portion in spaced relationship with the front flange for defining a hollow insulating section.

3. A bead according to claim 1, wherein the first flexible portion of the weatherstrip comprises dual strips parallel to each other.

4. A bead according to claim 1, wherein the bead frame is made of aluminum.

5. A polymeric bead for retaining and air sealing a windowpane to a framework, the bead being in position when interlocked with a lateral projection of the framework, the bead comprising:

a bead frame having a front and a rear longitudinally extending flange which are spaced apart from each other, the front flange being in facing relationship with the windowpane when the bead is in position;

a weatherstrip extending along the bead frame before the front flange and projecting therefrom, the weatherstrip comprising a first flexible portion for pressing against the periphery of the windowpane when the bead is in position, and a second flexible portion for pressing against the framework when the bead is in position; and securing means for interlocking the bead with the lateral projection of the framework, the securing means at least comprising a longitudinally extending tongue portion projecting from the bead frame and adapted to be engaged in a corresponding groove portion of the lateral projection of the framework.

6. A polymeric bead according to claim 5, wherein the first flexible portion of the weatherstrip comprises dual strips parallel to each other.

7. A window assembly comprising:

a framework having a lateral projection;

a windowpane set in the framework;

a bead for retaining and air sealing the windowpane to the framework, the bead being interlocked with the lateral projection of the framework, the bead comprising:

a bead frame having a front and a rear longitudinally extending flange which are spaced apart from each other, the front flange facing the windowpane;

a weatherstrip connected and extending along the bead frame before the front flange, the weatherstrip having a portion overlapping at least an end portion of the front flange for preventing direct contact of the front flange with the framework, the weatherstrip comprising a first flexible portion projecting therefrom and pressing against the periphery of the windowpane, and a second flexible portion projecting from the weatherstrip and pressing against the framework; and securing means for interlocking the bead with the lateral projection of the framework, the securing means at least comprising a longitudinally extending tongue portion projecting from the weatherstrip and engaged in a corresponding groove portion of the lateral projection of the framework.

8. A window assembly according to claim 7, wherein the flexible portion of the weatherstrip comprises dual strips parallel to each other.

9. A window assembly comprising:

a polymeric framework having a lateral projection;

a windowpane set in the framework;

a polymeric bead for retaining and air sealing the windowpane to the framework, the bead being interlocked with the lateral projection of the framework, the bead comprising:

a bead frame having a front and a rear longitudinally extending flange which are spaced apart from each other, the front flange facing the windowpane;

a weatherstrip extending along the bead frame before the front flange and projecting therefrom, the weatherstrip comprising a first flexible portion pressing against the periphery of the windowpane, and a second flexible portion pressing against the framework; and securing means for interlocking the bead with the lateral projection of the framework, the securing means at least comprising a longitudinally extending tongue portion projecting from the bead frame and engaged in a corresponding groove portion of the lateral projection of the framework.

10. A window assembly according to claim 9, wherein the first flexible portion of the weatherstrip comprises dual strips parallel to each other.

* * * * *